US005602554A

United States Patent [19]

Cepas et al.

[11] Patent Number: 5,602,554

[45] Date of Patent: Feb. 11, 1997

[54] ACTIVE ARRAY ANTENNA WITH MULTIPHASE POWER FOR ACTIVE MODULES

[75] Inventors: Bruce M. Cepas; Wilbur Lew, both of Mt. Laurel; Eric L. Holzman, Medford, all of N.J.; John G. Ferrante, Wilmington, Del.

[73] Assignee: Martin Marietta Corp., Moorestown, N.J.

[21] Appl. No.: 512,425

[22] Filed: Aug. 8, 1995

[51] Int. Cl.[6] ..... H01Q 3/22

[52] U.S. Cl. ..... 342/368

[58] Field of Search ..... 342/368, 371, 342/372, 376

[56] References Cited

U.S. PATENT DOCUMENTS

| | | | |
|---|---|---|---|
| 4,806,937 | 2/1989 | Peil | 342/375 |
| 5,173,706 | 12/1992 | Urkowitz | 342/99 |
| 5,280,297 | 1/1994 | Profera, Jr. | 343/754 |
| 5,339,086 | 8/1994 | DeLuca et al. | 342/371 |

OTHER PUBLICATIONS

"Transformer for AC/DC Power Supply Using 15 Phase Full Bridge", by Guenther et al, published at pp. 357–363 of Proceedings of the Electrical Manufacturing Coil Windings Show, Cincinnati, OH, 1992, of the International Coil Windings Association.

*Primary Examiner*—Gregory C. Issing

*Attorney, Agent, or Firm*—W. H. Meise; C. A. Nieves; S. A. Young

[57] ABSTRACT

A radar system which uses an active phased-array antenna achieves improved clutter improvement factor (CIF) by powering the various transmit-receive (TR) modules of the antenna with direct voltage (DC) derived from a plurality of phases of the power-line alternating current (AC). Each TR module receives power which originates with one phase of the source AC. The phases are selected so that the modulation of the radio-frequency (RF) signals by each TR module tends to cancel in the summed signal from the array antenna.

4 Claims, 3 Drawing Sheets

ACTIVE ARRAY ANTENNA WITH MULTIPHASE POWER FOR ACTIVE MODULES

FIELD OF THE INVENTION

This invention relates to active array antennas, and more particularly to such array antennas in which the transmit-receive, or transmit- or receive-only modules are grouped into sets, and each set receives direct energizing voltage derived from a different one of a plurality of phases of the alternating-current source.

BACKGROUND OF THE INVENTION

Active array antennas for use in radar systems may include many hundreds or thousands of antenna elements to achieve the desired beamwidth and number of beams. Each of the antenna elements, or each set of the antenna elements of an active array, is associated with an active module. Each active module operates on the radio-frequency (RF) signal transduced by the associated element(s), as by amplification, phase shifting, amplitude control, or the like. In this context, "active" means a module which requires, for its operation, electrical bias separate from the RF signals on which it operates. Passive RF operations are possible, such as phase shift, but in the absence of active elements, they can only be changed by mechanical means, as by adjusting a capacitor. Since one of the major advantages of an array antenna is that it may be "agile" (the beam can be quickly slewed and changed) when electronically controlled, almost all array antennas include active modules associated with the antenna elements. Such modules may be transmit-only, receive-only, or they may be transmit-receive (T/R or TR) modules when the array antenna is used for both transmission and reception. U.S. Pat. No. 5,339,086, issued Aug. 6, 1994, in the name of DeLuca et al., describes in general how TR modules are controlled in an array antenna context. U.S. Pat. No. 5,280,297, issued Jan. 18, 1994 in the name of Profera, describes the use of active modules for retransmission in the context of a reflectarray.

In a radar context, the transmissions, as for example transmit pulses, must have relatively high power. The power is achieved by "summing in space" the powers radiated by each of the antenna elements. Since the radiated RF power originates within the TR modules, the total energization power applied to the TR modules must be at least the sum of the transmitted RF power plus the losses in the TR module. In turn, the power requirements of a powerful radar system may be considerable, with the principal portion of the power going to the TR modules. Thus, operation of a radar system using an active array antenna requires a power source for the TR modules. U.S. Pat. No. 5,173,706, issued Dec. 22, 1992 in the name of Urkowitz, describes an active array antenna in the context of a radar system.

Ideally, the active portions of at least the analog components of a radar system are energized by pure direct voltage, also known as direct current (DC), to avoid the effects of noise on the direct voltage buses. For generating low-noise direct energizing voltages for the radar system, elaborate power-line filters and regulators are the norm. Those skilled in the art know that, notwithstanding these precautions, the direct energizing voltage always contains some residual noise, and that the circuits which are driven thereby should ideally be designed to reject energization voltage noise. Even when so designed, some residual modulation of the RF by the noise can occur, generally at the power-line frequency of 60 Hertz (Hz.) or its harmonics for ground-based systems, and 400 Hz. or its harmonics for airborne systems. The residual modulation, in turn, tends to adversely affect some of the normal functions of the radar, and especially those which depend for their operation upon cancellation of like signals, in which minuscule differences between the signals being canceled may result in an undesired residual signal. One function which is adversely affected by energization voltage noise is the clutter improvement factor (CIF), in which repetitive signals (clutter) are phase-shifted in alternate time periods, and added together in such a manner that they cancel.

Improved array antenna systems are desired.

SUMMARY OF THE INVENTION

An array antenna, which is adapted to be energized from a source of alternating current, includes a plurality of antenna elements. A plurality of active modules is coupled to the antenna elements in such a manner as to allow for the flow of RF signals therebetween. Each of the active modules comprises active devices for operating on the RF signals passing through the module. The active modules are grouped into a plurality of energization sets, so that each module is associated with one of the energization sets. An AC-to-DC converter is coupled to a source of multiphase AC line power and to the active modules, for separately converting each phase of the multiphase AC line power into DC. Thus, there are a plurality of DC sources, each of which is derived from a different one of the phases of the multiphase AC line power. Each of the plurality of DC sources is coupled to a different one of the energization sets, for energization of the active modules thereof. In a particular embodiment of the invention, the AC-to-DC converter includes a plurality of AC-to-DC converters coupled to the source of multiphase AC line power, for generating a plurality of intermediate direct voltages, each derived from a different one of the phases of the AC line power, and further includes a DC-to-DC converter coupled to each of the AC-to-DC converters and to the active modules, for converting the intermediate direct voltages into voltages suitable for powering the active modules. A particular antenna may be powered by a multiphase AC transformer, adapted to be coupled to a source of AC line power having a first number of phases, for converting the AC line power having a first number of phases into the multiphase AC, where the first number of phases is less than the number of phases in the multiphase AC.

DESCRIPTION OF THE INVENTION

Figure 1:
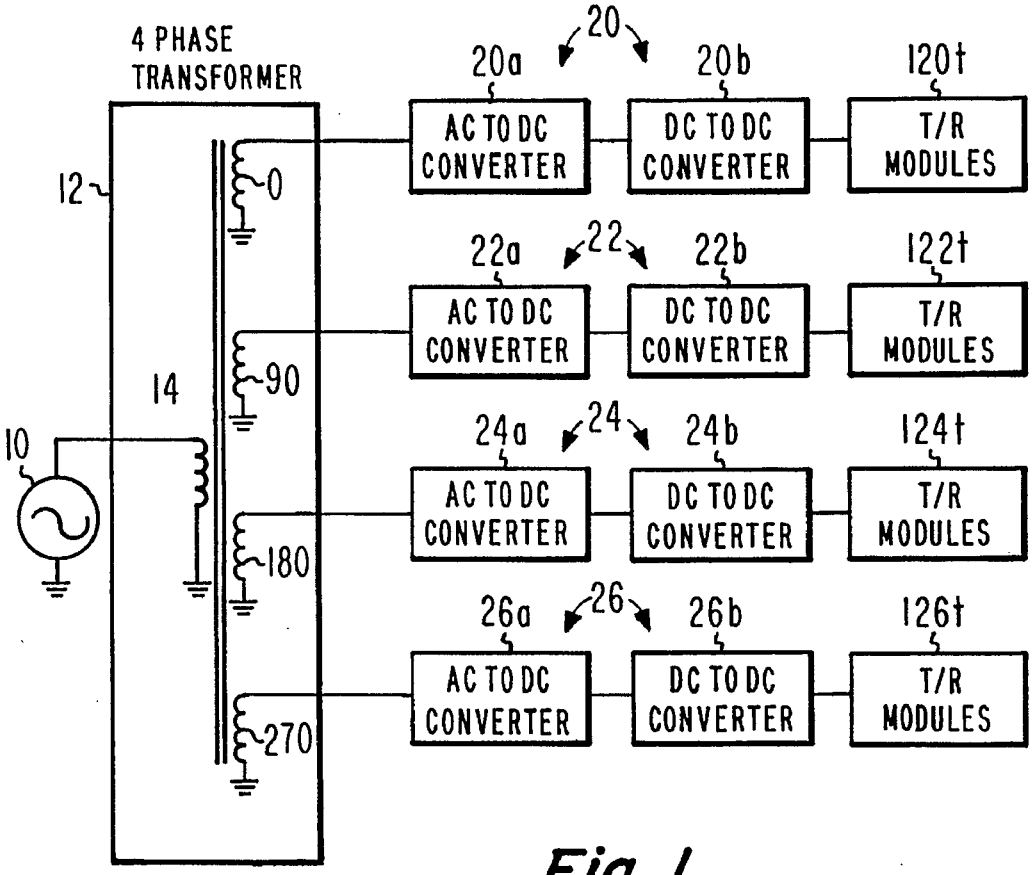
FIG. 1 is a simplified diagram, partially in block form and partially in schematic form, illustrating an energizing power system according to the invention for a plurality of TR modules.

In FIG. 1, a source of single-phase 60 Hz. alternating current (AC) line voltage is illustrated by a generator symbol 10. A four-phase transformer 12 has its primary winding 14 connected to AC source 10, and produces one of four phases at each of its four secondary windings 0, 90, 180, and 270. More particularly, winding 0 produces reference phase zero, winding 90 produces AC at a phase of 90° at 60 Hz. relative to reference phase 0, winding 180 produces AC at a relative phase of 180°, and winding 270 produces AC at a relative phase of 270°. At the right of FIG. 1, a plurality of TR modules are illustrated as blocks 120*t*, 122*t*, 124*t*, and 126*t*. An AC-to-DC converter 20 is illustrated as including two blocks, and converts the AC to direct voltage for energizing the TR module or modules represented by block 120*t*. Similarly, AC-to-DC converters 22, 24, and 26 are coupled to windings 90, 180, and 270, respectively, for converting the AC of their respective windings into DC for energizing the TR modules represented by blocks 122*t*, 124*t*, and 126*t*, respectively.

An active array antenna may have thousands of antenna elements, and a TR module for each element. Those skilled in the art know that the solid-state devices which are appropriate for a TR module require significant current at relatively low voltage. If the conversion between AC and the DC energization voltage is performed in one step, the power for all the TR modules must be distributed at the same low voltage which is appropriate for direct energization of a TR module. The voltage is likely to be less than 15 volts, and each module may require 100 milliamperes or more. For an array with thousands of TR modules, the power buses would have to be capable of carrying 100 amperes at 15 volts, which might require buses of inconvenient size and weight. This problem is ameliorated by two-step distribution, in which each. AC-to-DC converter is made up of a first converter for converting AC to DC at a relatively high voltage. The power is distributed at the relatively high DC voltage, as a result of which the required power can be distributed at a correspondingly lower current, and at a location near the TR module(s) to be energized, is converted to a lower DC voltage appropriate to powering the TR modules. The conversion to a lower DC voltage is performed by a DC-to-DC converter, which includes as a constituent thereof one or more transformers, which result in converting the relatively high DC voltage at low current into a relatively low voltage at a higher current. Thus, in FIG. 1, AC-to-DC converter 20 includes an AC-to-high-DC converter 20*a* and a high-DC-to-low-DC converter 20*b*, which drives the TR modules associated with block 120*t*. Similarly, AC-to-DC converter 22 includes an AC-to-high-DC converter 22*a* and a high-DC-to-low-DC converter 22*b*, which drives the TR modules associated with block 122*t*, AC-to-DC converter 24 includes an AC-to-high-DC converter 24*a* and a high-DC-to-low-DC converter 24*b*, which drives the TR modules associated with block 124*t*, and AC-to-DC converter 26 includes an AC-to-high-DC converter 26*a* and a high-DC-to-low-DC converter 26*b*, which drives the TR modules associated with block 126*t*. The conductor buses extending between each AC-to-DC converter and the following DC-to-DC converter may be relatively long, since the power must start from a central location, and arrive at the location of the TR modules which are to be powered before the conversion to a lower DC voltage can be made.

Figure 2:
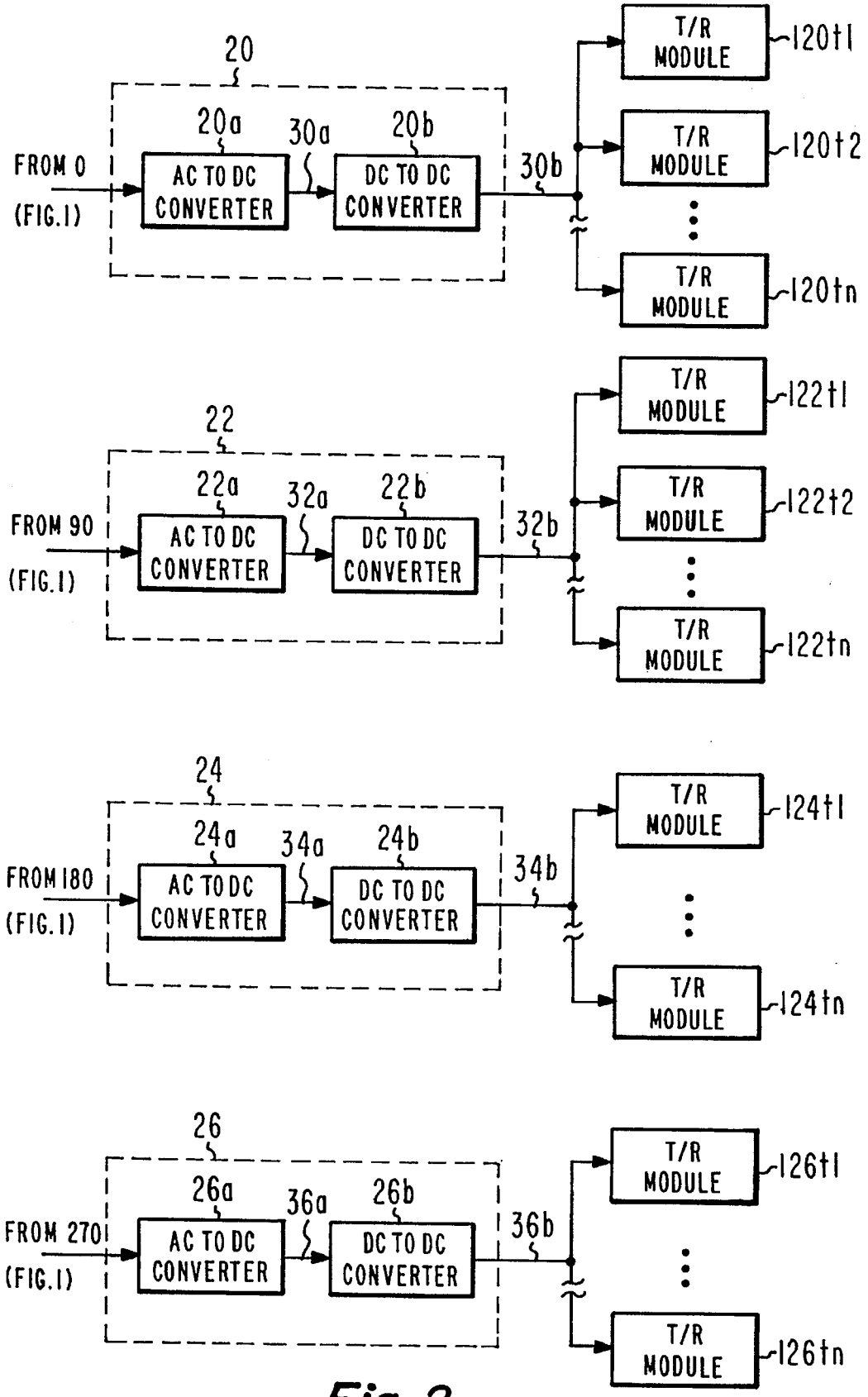
FIG. 2 is a simplified block diagram, illustrating another possible arrangement for powering TR modules according to the invention.

FIG. 2 illustrates another embodiment of the invention, in which each AC-to-DC converter 20, 22, 24, 26 includes a single AC-to-DC converter, which drives plural TR modules. In FIG. 2, AC power arrives at AC-to-DC converter 20 from winding 0 of FIG. 1, and is converted into relatively low DC voltage on a bus conductor 30*b*. The low-voltage DC derived from phase 0 is distributed over bus 30*b*, in parallel or in common to a plurality of TR modules 120*t*1, 120*t*2, . . . 120*tn*. Similarly, the low-voltage DC derived from phase 90 is distributed over a bus 32*b*, in parallel, to a plurality of TR modules 122*t*1, 122*t*2, . . . 122*tn*, the low-voltage DC derived from phase 180 is distributed over a bus 32*b*, in parallel, to a plurality of TR modules 124*t*1, 124*t*2, . . . 124*tn*, and the low-voltage DC derived from phase 270 is distributed over a bus 36*b*, in parallel, to a plurality of TR modules 126*t*1, 126*t*2, . . . 126*tn*. While the TR modules which receive energizing power originating from any particular phase of energizing power are illustrated as being side-by-side in FIG. 2, these TR modules are each co-located or collocated with their respective elemental antennas, and may be distributed throughout the area of the array antenna, with TR modules powered from other phases interposed therebetween.

The invention, as so far described, has the advantage that the residual power-line noise, including harmonics of the power-line frequency (60 or 400 Hz.) at frequencies potentially ranging up to several thousand Hz, which is coupled to the TR modules appears at different phases in different TR modules, and thus tends to cancel in the sum RF signal at the output of the beamformer. It should be emphasized that, while the TR modules of each set 120*t*, 122*t*, 124*t*, and 126*t* are desirably "near" each other insofar as the length of DC distribution bus 30, 32, 34, and 36, respectively, they may not be, and in general probably are not "near" each other in terms of mutual proximity of their respective radiating antenna elements in the radiating aperture.

Figure 3:
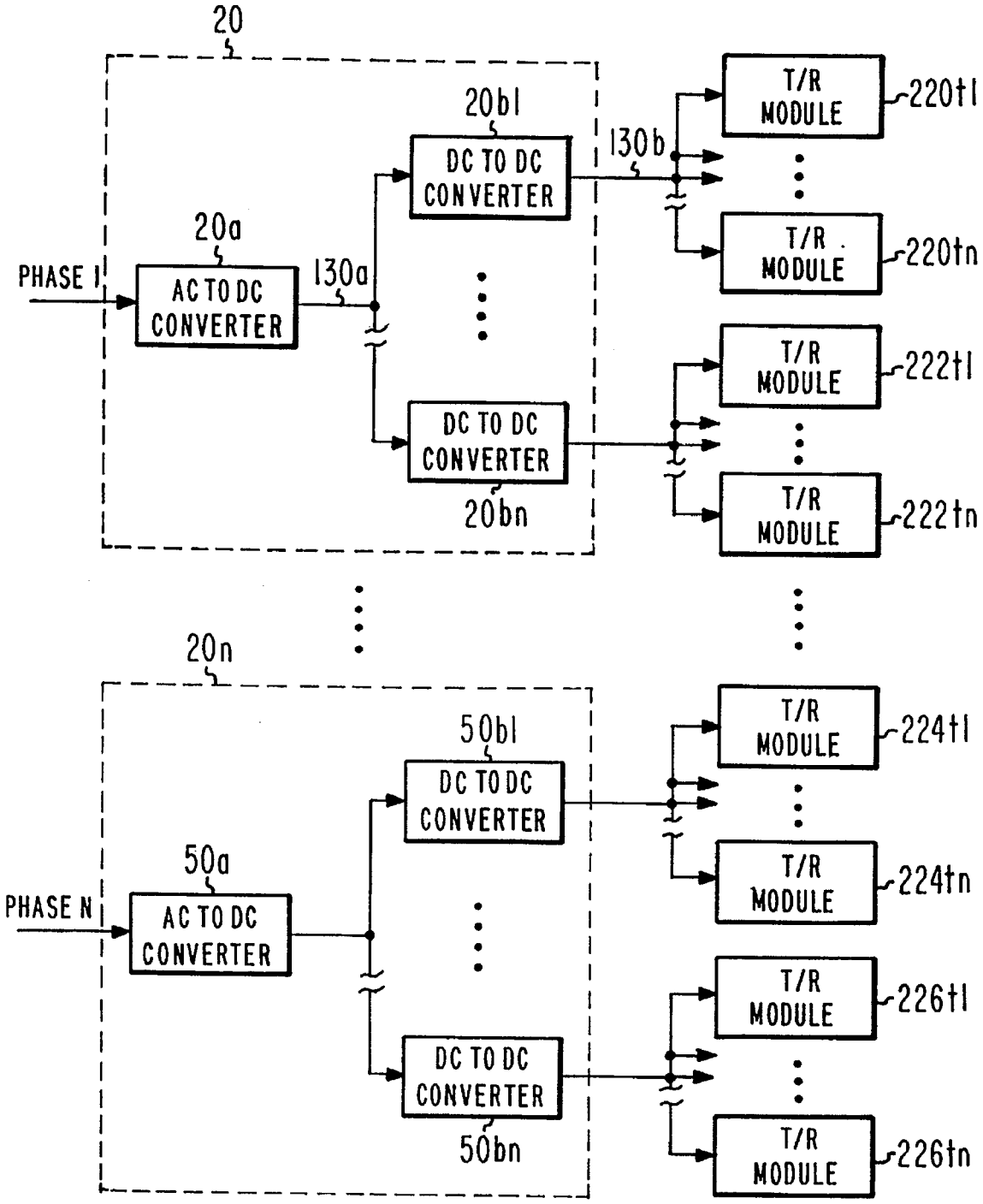
FIG. 3 is a simplified block diagram, illustrating yet another possible arrangement for powering TR modules according to the invention.

FIG. 3 illustrates another embodiment of the invention, in which each AC-to-DC converter 20, . . . , 20*n* includes a plurality of DC-to-DC converters, each of which drives plural TR modules. In FIG. 3, AC power arrives at AC-to-DC converter 20*a* from winding 1 of FIG. 1, and is converted into relatively high DC voltage on a bus conductor 130*a*. The high-voltage DC derived from phase 0 is distributed over bus 130*a* to a plurality of DC-to-DC converters 20*b*1–20*bn*. Each DC-to-DC converter 20*b*1–20*bn* supplies DC, by way of paths 130*b*1, . . . , 130*bn* to the associated TR modules 220*t*1, . . . , 220*tn*; . . . ; 222*t*1, . . . , 222*tn*. Similarly, AC-to-DC converter 20*n* receives phase n AC and converts it to DC in an AC-to-DC converter 50*a*. The relatively high DC voltage from converter 50*a* is applied to a plurality of DC-to-DC converters 50*b*1, . . . , 50*bn*, each of which converts the high voltage DC to lower-voltage DC. The low-voltage DC produced by each DC-to-DC converter 50*b*1–50*bn* is supplied to the associated TR modules 224*t*1, . . . , 220*tn*; . . . ; 226*t*1, . . . , 226*tn*.

Multiphase transformers suitable for use as transformer 12 of FIG. 1 are known, and are available from, for example, NWL Transformers, Inc. Rising Sun Road, Bordentown, New Jersey 08505. It is believed that such transformers have "ring" windings comparable to conventional "WYE" windings, and the various phases are derived from combinations of various taps along the ring winding.

The output of the phased-array antenna may be considered to be the common RF port in a receiving condition, or the RF signal which is summed in space in a transmitting mode. The transmitted signal can be sampled by use of a probe antenna which samples the transmitted field. The noise power at the output of the antenna includes components which arise from interaction, in the TR modules, of RF signal with noise on the DC power buses. The noise contributions attributable to the switching frequencies of the DC-to-DC converters can be readily reduced by relatively simple filtration, because of the high operating frequencies of the converters. However, harmonics of the power-line frequencies are more difficult to filter, and may appear on the buses. The noise power at the output of the antenna, then is described by the equation $$P_{noise}=\left|\sum_{i=1}^{N}\frac{A}{N}e^{j\phi_i}\right|^2=\left(\sum_{i=1}^{N}\frac{A}{N}\cos\phi_i\right)^2+\left(\sum_{i=1}^{N}\frac{A}{N}\sin\phi_i\right)^2 \quad (1)$$

where

A is the total number of elemental antennas or radiators;

N is the number of transformer taps or different bus phases; and $\phi_i=i*\theta$ is the relative phase of the $i^{th}$ tap, and $\theta$ equals 360° /N.

Relative to the desired signal at the output of the antenna, the 60 Hz. harmonic noise is suppressed by S dB, where $$S=10\log_{10}\frac{A^2}{P_{noise}}=20\log_{10}\frac{N}{\left|\sum_{i=1}^{N}e^{j\phi_i}\right|} \quad (2)$$

Figure 4:
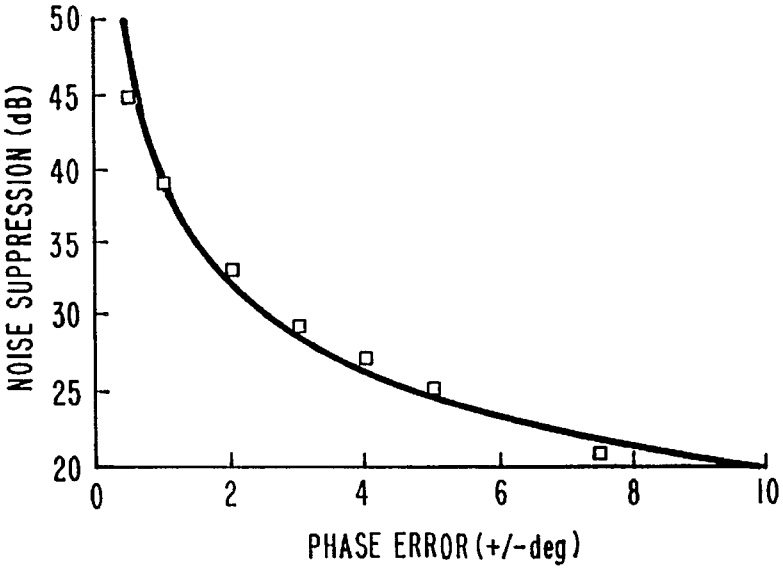
FIG. 4 is a plot of noise suppression as a function of phase error for a four-phase system.

A realistic way to specify a transformer's output phase offset is to specify a phase error range on each of the N taps. Thus, we write $\phi_i$ as $i*\theta\pm\delta_i$, where $\delta_i$ is the phase error on the $i^{th}$ tap. If we solve equation (2) for a large number of cycles of the transformer, each cycle choosing the $\delta_i$'s randomly within a specified error range, we can determine the probability that a certain suppression will be achieved for that range. FIG. 4 plots the noise suppression for the four-phase transformer (ideal tap phase offset equal to 90 degrees) versus tap phase error range. The plot locus corresponds to a 100% probability of achieving the associated noise suppression. Thus, from the plot, a phase error of ±4 degrees on each transformer tap should result in a noise suppression of about 26dB at the output of the T/R modules.

Other embodiments of the invention will be apparent to those skilled in the art. For example, while conversion from single-phase AC to four-phase AC has been explicitly described, the conversion could be to any number of phases.

What is claimed is:

1. An array antenna adapted to be energized from a source of alternating current, said antenna comprising;

a plurality of antenna elements;

a plurality of active modules coupled to said antenna elements for the flow of RF signals therebetween, each of said active modules comprising active means for operating on said RF signals, said active modules being grouped into a plurality of energization sets so that each module is associated with only one of said energization sets;

a source of multiphase AC line power;

AC-to-DC conversion means coupled to said source of multiphase AC line power and to said active modules, for separately converting each phase of said multiphase AC line power into DC, to thereby form a plurality of DC sources, each derived from a different one of said phases, and for coupling each of said plurality of DC sources to a different one of said energization sets for energization thereof.

2. An antenna according to claim 1, wherein said AC-to-DC conversion means comprises a plurality of AC-to-DC conversion means coupled to said source of multiphase AC line power, for generating a plurality of intermediate direct voltages, each derived from a different one of said phases of said AC line power, and further comprising DC-to-DC conversion means coupled to each of said AC-to-DC conversion means and to said active modules, for converting said intermediate direct voltages into voltages suitable for powering said active modules.

3. An antenna according to claim 1, wherein said a source of multiphase AC line power further comprises:

multiphase AC transformation means, adapted to be coupled to a source of AC line power having a first number of phases, for converting said AC line power having a first number of phases into said multiphase AC, where said first number of phases is less than the number of phases in said multiphase AC.

4. An antenna according to claim 3, wherein said first number of phases is one, and said number of phases in said multiphase AC is four.

* * * * *